United States Patent [19]

Kicherer et al.

[11] Patent Number: 4,699,269

[45] Date of Patent: Oct. 13, 1987

[54] HOTPLATE STACKER

[75] Inventors: Robert Kicherer; Josef Krist, both of Oberderdingen; Jens-Uwe Reinhardt, Bretten, all of Fed. Rep. of Germany

[73] Assignee: E.G.O. Elektro Geräte Blanc und Fischer, Fed. Rep. of Germany

[21] Appl. No.: 786,215

[22] Filed: Oct. 10, 1985

[30] Foreign Application Priority Data

Oct. 31, 1984 [DE] Fed. Rep. of Germany ..... 3439777

[51] Int. Cl.[4] ..... B65D 85/00; B65D 21/00

[52] U.S. Cl. ..... 206/320; 260/501; 260/821

[58] Field of Search ..... 206/499, 501, 507, 509, 206/821, 320

[56] References Cited

U.S. PATENT DOCUMENTS

| | | | |
|---|---|---|---|
| 1,757,192 | 5/1930 | Hothersall . | |
| 2,687,231 | 8/1954 | Somers . | |
| 3,642,165 | 2/1972 | von der Osten . | |
| 4,366,905 | 1/1983 | Forshee | 206/821 |
| 4,415,077 | 11/1983 | Murphy | 206/821 |
| 4,440,300 | 4/1984 | Kanazawa et al. | 206/821 |

FOREIGN PATENT DOCUMENTS

| | | |
|---|---|---|
| 1190397 | 12/1965 | Fed. Rep. of Germany . |
| 1951958 | 12/1966 | Fed. Rep. of Germany . |
| 1203177 | 6/1968 | Fed. Rep. of Germany . |
| 1756834 | 8/1970 | Fed. Rep. of Germany . |
| 2000371 | 11/1970 | Fed. Rep. of Germany . |
| 8121160 | 6/1981 | Fed. Rep. of Germany . |
| 1043648 | 6/1964 | United Kingdom . |

*Primary Examiner*—Joseph Man-Fu Moy

*Attorney, Agent, or Firm*—Steele, Gould & Fried

[57] ABSTRACT

A stacker has support units with in each case a plurality of support members for in each case two superimposed hotplates distributed over the hotplate circumference and connected by connecting elements so as to be slightly elastically movable relative to one another. The hotplates engage in centered manner in the support units, in such a way that the central axes of the two hotplates engaging in a support unit are mutually displaced at least by the diameter of the fixing bolts projecting over the undersides of the hotplates. For the arrangement under in each case one double layer of hotplates spaced by support units, intermediate layers are provided having on their upper surfaces centering cavities for the engagement of the hotplates and on their bottom surfaces having protective layers for the careful placing on the in each case underlying hotplates.

27 Claims, 8 Drawing Figures

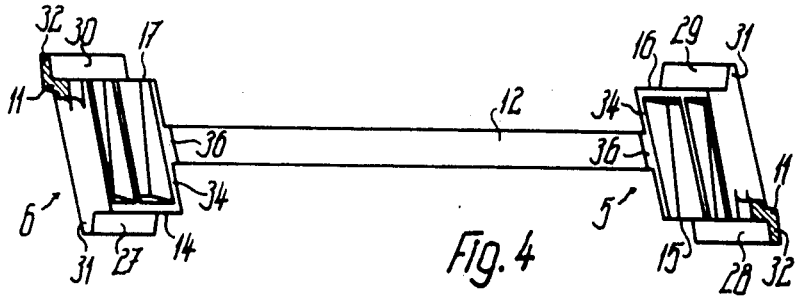
Fig. 4
Fig. 5
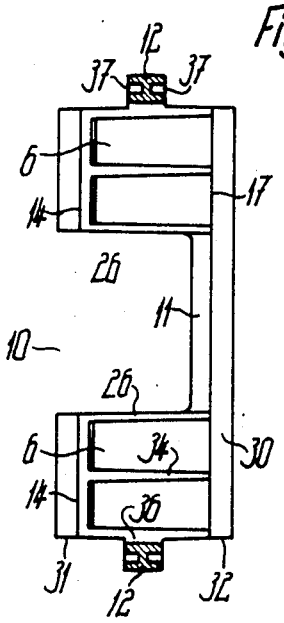
Fig. 6
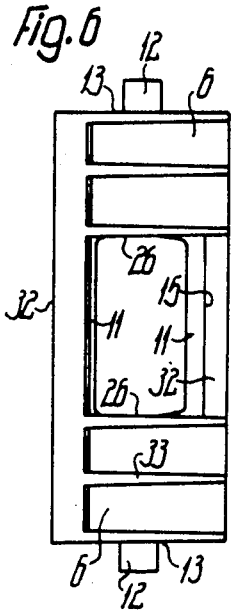

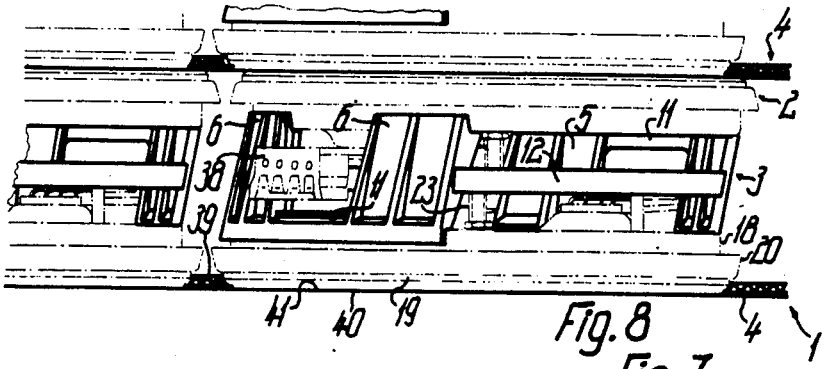
Fig. 8
Fig. 7
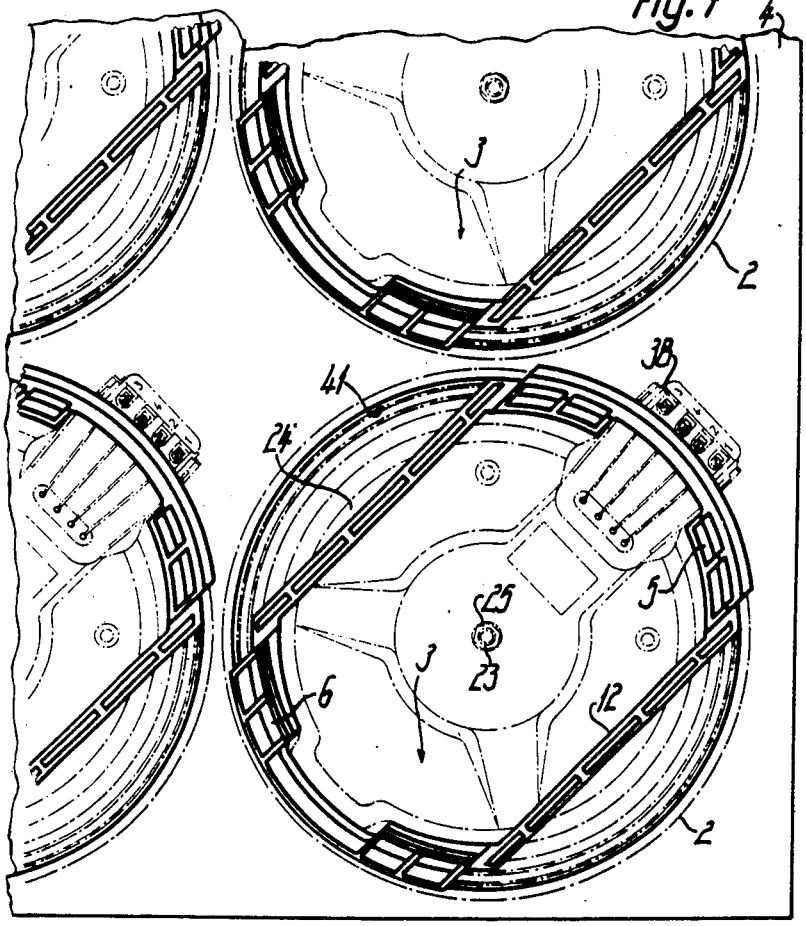

HOTPLATE STACKER

BACKGROUND OF THE INVENTION

The present invention relates to a hotplate stacker with in each case one support unit for the spacing arrangement between two superimposed hotplates and with bearing surfaces provided on the upper and lower ends of support members of the support unit for supporting engagement distributed around the hotplate circumference on the two associated hotplates.

Electric hotplates or hobs or the like, which generally have a cast steel, electrically heated plate base member frequently have a very high weight and are sensitive to damage, particularly due to scratching of the cooking heating surface formed by the plate base member. Thus, hotplates, if stacked together for storage, transportation, etc, must be very carefully and stabily supported, particularly to ensure no reciprocal sliding of the hotplates within the stack. Attempts hitherto to solve this problem have been based on the insertion of wooden blocks as support members, but this system leads to disadvantages in that the security of the stack is dependent on the skill of the person inserting the blocks, which also takes up a considerable amount of time. When inserting the small wooden blocks, it must also be ensured that they do not come to rest in areas where they could collide with those parts of the hotplates, which project over the bottoms of the hotplates.

SUMMARY OF THE INVENTION

The problem of the invention is to provide a stacker for hotplates which, while simple to use, ensures a reliable and precisely oriented stacking of said hotplates.

In a hotplate stacker of the aforementioned type according to the invention, this problem is solved in that the support members have connecting members for the aligned or oriented direct interconnection thereof. As a result individual or all the support members of one/or adjacent support units can be interconnected in such a way that their reciprocal position is substantially precisely defined and consequently the positioning of the support member simultaneously ensures the accurate arrangement of further support members in the stacking position. This connection also considerably increases the storage stability of the support members, so that they can be made of relatively thin material and as a result the stacker has only a limited weight.

In a preferred embodiment, at least one connecting member interconnects all the support members of a support unit, so that the hotplates can be arranged in vertical stacking columns and the support units of adjacent stacker columns are not directly interconnected. However, it is also conceivable to interconnect horizontally adjacent, juxtaposed support members for support units and/or to have a detachable connection between support members, eg using lockable snap connections. However, it is particularly appropriate if the connecting member or members are in one piece with the associated support members, so that the particular stacking aid having two or more support members can be manufactured in a simple manner, eg from plastic.

A particularly accurate alignment of the hotplates on the support unit is ensured if the latter, particularly at the particular support member, has at least one peripheral centering surface for the hotplate, the centering surface preferably being connected to the radially outer boundary of the associated bearing surface and projecting above the same, so that the sides of the associated circumferencial surface of the hotplate are also protected. The bearing surface is appropriately adapted for engagement on the lower end face of a ring flange, which is formed by a cast iron plate base member and close to the maximum diameter of the hotplate projects freely over the bottom surface in anular annular manner.

In order that the hotplate can be particularly simply inserted in the support unit, the centering surface preferably formed by a curved web connected to the outer circumference of the support unit, converges towards the bearing surface with the hotplate central axis, whilst in particular forming an obtuse angle with the bearing surface, so that a funnel-shaped insertion surface is formed.

In the case of a particularly advantageous further development of the invention, in each case two support members are juxtaposed on the hotplate circumference and said two support members form a gap between them, particularly a U-shaped cutout for the engagement of a hotplate connecting member, which generally in the form of a ceramic member or the like is fixed to a lower sheet metal cover of the plate base member, projects over the bottom surface of the cover and the ring flange of the plate base member and radially projects over the largest diameter of the hotplate. As said connecting member is located in the gap, this leads to a precisely defined arrangement of each hotplate in the stack, also with respect to the rotation position about the hotplate central axis and in this arrangement the hotplate is fixed by the centering engagement of its connecting member in the cutout of the stack unit. If two gaps facing one another with respect to the hotplate central axis are opened to opposite sides, then two hotplates can be simply inserted in the stacked unit in random order in the direction of their central axes. The bearing surface between adjacent support members can pass in circular arc manner over the width of the gap, the two support members in this area being interconnected by a connecting element defining the gap at the associated side.

According to a further proposal of the invention, the support unit is free from support members on two facing sides with respect to the hotplate central axis and is preferably defined in radially inwardly displaced manner with respect to the diameter of the particular bearing surface, which leads to a more compact construction of the support unit. According to a preferred embodiment, two diametrically facing pairs of support members are provided, whereof each pair assumes an arc angle of less than 180°, particularly approximately 80°, so that there is a very space-saving and reliably supporting construction in the support unit.

Facing support members can be interconnected in an adequately stable manner by means of lateral cord-like, substantially linear connecting elements or connecting elements which are approximately at right angles to the hotplate central axis. There are preferably two parallel connecting elements with approximately the same distances from the hotplate central axis and which are smaller than the radius of the bearing surface and the support members are secured against one another at substantially stable relative positions.

The compact construction of the support unit or stacking means resulting from the aforementioned features is also advantageous during the return transport thereof for reuse after removing the hotplates and storing the stacking means in the case of non-use. These advantages are further increased in that the support unit is constructed in stackable manner with a plurality of further and in particular identical support units of the means. The lateral connecting elements preferably only take up part of the height of the support members, in particular are located roughly in the centre of the height between the bearing surfaces and their inner faces, at least in the terminal connecting area to the associated support members are slightly outwardly displaced with respect to the associated lateral faces. Thus, in each case two support units can be nested in one another at a height which is much smaller than the sum of the individual heights of the support units, namely only roughly twice as high as the height of the cord-like connecting elements, which directly rest on one another in the case of support units nested or stacked in one another, whilst the support members of the in each case upper support unit are located on one side on the inner circumference and on the other side on the outer circumference of the in each case underlying support unit.

The uniform engagement of the hotplates on the bearing surfaces is improved in that adjacent support members are movably interconnected elastically and/or flexibly limited manner with respect to one another in several directions and in particular at right angles to the bearing surfaces. Connecting elements in the manner of flexural members are preferably slightly deformable, so that the support unit, which is frame-like in plan view, can be elastically interengaged or interconnected, the cord-like connecting elements elastically twisting in the manner of torsion bars. Appropriately all the support members are slightly reciprocally movable, so that the particular support unit can be automatically brought in to the best support position under the weight of the hotplates.

A particularly advantageous further development of the invention is obtained in that the substantially parallel hotplate central axes of the two bearing surfaces adapted to the undersides of two hotplates on either side of the particular support unit are displaced with respect to one another by at least the diameter of the projecting fastening bolts on the undersides of the hotplates, so that the hotplates engaging in a support unit with their undersides facing one another can be axially spaced from one another with respect to their undersides, said axial spacing being only slightly larger than the length of the part of the fastening or mounting bolt projecting over the underside. So that, despite the mutual displacement, the support members can be compactly constructed in part dish-shaped manner, in axial section they slope in accordance with this displacement, so that they virtually form parts of a cylindrical jacket, which is cut off at two parallel end faces in sloping manner with respect to its central axis.

To ensure that in a stack, those adjacent hotplates, which are supported on one another by their facing top surfaces, ie, their cooking heating surfaces, engage in a careful manner, according to the invention there is at least one plate-like intermediate layer for the arrangement between the facing cooking heating surfaces of the double layers of hotplates spaced from one another by support units. So that this intermediate layer also has a centering or fixing action on at least one hotplate, the intermediate layer is appropriately provided on the one side with a centering cavity for each hotplate to be placed on and on the other side has a smmoth protective coating, particularly a coatedon plastic foil, so that it is not possible for the cooking heating surfaces to be scratched by rubbing together. It has proved appropriate to place said intermediate layer, which can have in a reference grid a plurality of centering cavities in juxtaposed manner, with the protective coating downwards on the cooking heating surfaces of a plurality of hotplates arranged in a corresponding reference grid and then to place a corresponding or identical number of hotplates in the upwardly open centering cavities, so that the hotplate face members forming the cooking heating surface thereof engages with the outer circumference connected to the cooking heating surface in centred manner in the in each case associated cavity.

In a simple embodiment, which has good impact absorption characteristics, the intermediate layer has a corrugated paper layer which particularly comes from the circular centering cavity and is provided on one side with a solid cardboard layer forming the protective layer and the closed bottom of the central depression, so that the intermediate layer has a simple construction and limited thickness, but ensures high stability.

BRIEF DESCRIPTION OF THE DRAWINGS

The invention is described in greater detail hereinafter relative to nonlimitative embodiments and the attached drawings, wherein show :

FIG. 4 a section along line IV—IV of FIG. 1.

FIG. 5 a section along line V—V of FIG. 1.

FIG. 6 the support unit according to FIG. 1 in side view from the left.

FIG. 7 a detail of a stacking means occupied by hotplates indicated in broken line form and in plan view.

FIG. 8 a view of the detail according to FIG. 7.

DETAILED DESCRIPTION OF THE PREFERRED EMBODIMENTS

Figure 2:
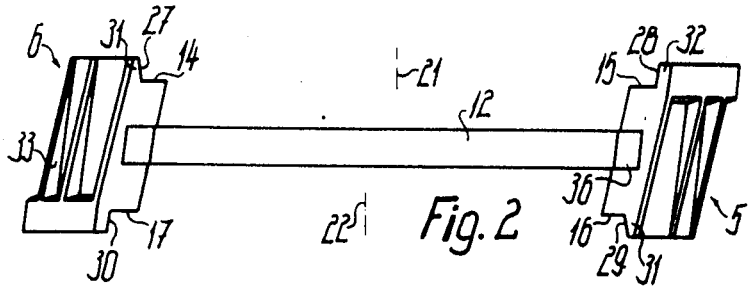
FIG. 2 a view of the support unit according to FIG. 1.
Figure 1:
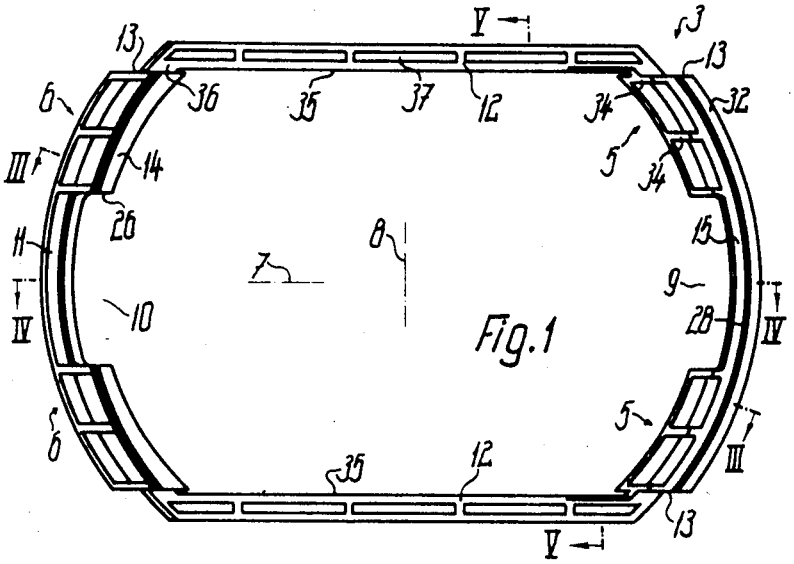
FIG. 1 the support unit of a stacking means according to the invention in plan view.
Figure 3:
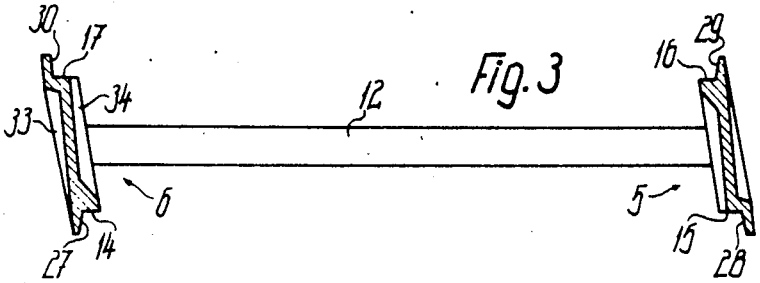
FIG. 3 a section along line III—III of FIG. 1.

As shown in FIGS. 1 to 8, a stacker 1 for electric hotplates 2 according to the invention has a plurality of identical, spaced and not directly interconnected one-part support units 3 arranged in a rectangular row/-column reference grid, as well as a plurality of superimposed flat, substantially planar intermediate layers 4 arranged in each case between a double layer of hotplates 2 and whose surface extension is only slightly larger than the zone jointly taken up by the hotplates 2 arranged in a double layer in the grid.

Each support unit 3 has four substantially identical support members 5, 6, which are upright in the use position and which are arranged symmetrically to the median longitudinal plane 7 of support unit 3 and which are only approximately symmetrical to the median plane 8 at right angles thereto. In each case two support members 5, 6 are positioned in pairwise spaced manner in either side of the median longitudinal plane 7 in juxtaposed form, but the two pairs of support members 5, 6 located on either side of median plane 8 are displaced by 180° about an imaginary axis in median plane 8 and at right angles to the median longitudinal plane 7 and in the centre of the height of support unit 3. Between the two in each case adjacent support members 5, 6, they define with their facing, parallel lateral edges in each case a U-shaped bounded gap 9, 10, gap 9 on one side being open to the bottom and gap 10 on the other side open to the top. At the bottom, the particular gap is defined by a continuous, circular arc-shaped connecting element 11 between the two associated support members 5, 6 and which in the associated height portion forms a continuous extension of the arc-shape of the associated, substantially cylindrical partial dish-shaped support members 5, 6. The facing pairs of support members 5,6 are interconnected by two parallel, approximately rectangular bar-shaped connecting elements 12, which in each case are connected to the remote lateral edges 13 of the connecting elements 5, 6 of each pair, only take up a fraction of their height, are located at approximately right angles to median plane 8 and are located roughly in the centre of support members 5, 6. The connecting elements 12 for reducing the torque loads of the support members 5, 6 can also be arranged roughly at right angles to the tilted position of the support members or can slope away by a few radians counter to the tilting position, ie from left to right in FIG. 2, eg under an angle of approximately 6° to the central axis 21, 22. At the top and bottom of the support unit 3, support members 5, 6 in each case form an articulated bearing surface 14, 15 or 16, 17 for the approximately circular ring flange 18 of the cast iron plate base member 19 of a hotplate 2 projecting over the bottom surface, said ring flange 18 being positioned with a limited radial spacing within a hotplate shield ring 20 which in the vicinity of its upper end face is closly connected to the plate base member 19 and conically diverges downwards to its open end face and defines the largest diameter of hotplate 2 and via which the ring flange 18 projects downwards by roughly the height of said shield ring 20. The portions of bearing surface 14, 15 or 16, 17 located in the common plane at right angles to the median planes 7, 8 are in each case distributed in circular arcshaped manner about an associated hotplate central axis 21 or 22 with identical radial spacings, the two central axes 21, 22 being positioned parallel to median plane 8 in the median longitudinal plane 7 and on either side of the median plane 8 and are identically spaced with respect to the latter or have a distance from one another of eg approximately 8 mm. This spacing is only slightly larger, eg approximately one third larger than the diameter of the central fixing bolts 23 of hotplates 2 formed by metric external thread shanks and in each case the bolt is arranged in the central axis of each hotplate 2 projecting over the underside thereof. The fixing bolts 23 generally screwed into a central internal threaded eye of plate base member 19 it serves on the one hand to hold a cup-shaped cover 24 closing the underside of member 19 within the ring flange 18 with the aid of a nut 25 mounted on the bolts and engaging on the underside of cover 24 and on the other hand with its portion which freely projects downwards by more than the height of plate base member 19 for fixing the hotplate in its installation position in a hob or the like. The bearing surface 15 or 17 on the side where the two associated support members 5, 6 are interconnected by a connecting element 11, passes continuously over said connecting element in such a way that the bearing surface 15 or 17 in this area uninterruptedly assumes an arc angle of approximately 80°. In this area in which gap 10 or 11 is provided between support members 5 or 6, the bearing surface 14 or 16 is formed by two identical arc-shaped portions spaced from one another on either side of the median longitudinal plane and which in each case pass uninterruptedly between two parallel lateral edges 13, 16 of the in each case associated support member 5 or 6. The distance between the planes in which the bearing surfaces 14, 15, 16, 17 are located is only slightly larger than the amount by which the particular fixing bolt 23 projects over the lower end face of the ring flange 18 of the associated hotplate. The largest diameter of the bearing surfaces 14, 15 and 16, 17 is only slightly larger than the maximum diameter of said end face.

A circumferential centering surface 27, 28 or 29, 30 is associated with each portion of each bearing surface 14, 15 and 16, 17 and projects over the associated portion of bearing surface 14, 15 or 16, 17 by an amount which is roughly half the height of ring flange 18 and slightly smaller than the amount by which the ring flange 18 projects over the underside of shield ring 20. Circumferential centering surfaces 27 to 30, which are connected to the radially outer boundaries of bearing surfaces 14 to 17, are in cross-section to the latter under obtuse angles, wherein in the vicinity of those bearing surfaces 16, 14 which are interrupted by gaps 9, 10, said angle is slightly larger than in the area in which said bearing surfaces 15, 17 pass over the associated connecting elements 11, so that the particular hotplate engages in simple manner initially in inclined form on bearing surface 14, 16 and can then be pivoted up to a secure engagement on the associated faceing bearing surface 15 or 17. Each circumferential centering surface 27 to 30 is formed by the inner circumferential surface of a curved web 31 or 32 projecting axially over the associated bearing surface 14 to 17 and whose height is approximately the same as the width of the associated bearing surface. In the vicinity of the open sides of gaps 9, 10, the particular curved web or the associated circumferential centering surface is also interrupted, whereas where the bearing surface 15 or 17 passes over the gap, it is provided in continuous form.

In order to obtain the eccentricity of centering axes 21, 22 of bearing surfaces 14, 15 and 16, 17, the substantially flat, dish-shaped support members have the same orientation relative to the median plane 8 on either side of the latter or slope in a substantially parallel form by a few radians. For increasing the strength of suport members 5, 6 in the case of a lightweight construction, said members are provided with upright ribs on their outsides and insides which, on the outsides, in each case decrease in height from the level of the associated bearing surface 15 or 17 passing over the gap to the other end of the associated support member 5 or 6 in such a way that their free longitudinal edges on the one hand pass continuously into the outer circumferential surface of the curved web 32 and on the other hand the height thereof decreases substantially to zero up to the free end face of the other curved web 31. Thus, in the height direction, there is a relatively smooth-surfaced outer face of support members 5, 6.

On the insides, the height of the ribs decreases slightly in the opposite direction, so that there associated end faces form part of the bearing surface 15 or 17 passing over the particular gap 9 or 10. As a result, the annularly defined part of said bearing surface 15, 17 can be kept relatively narrow. Both the ribs 33 on the outsides of the support member 5, 6 and the ribs 34 on the insides thereof are constructed integrally in one piece with the particular associated support member.

The facing inner faces 35 of the connecting elements 12 which are parallel to one another or to the median longitudinal plane 7 are outwardly displaced by a small amount substantially over their entire length with respect to the associated outer lateral edges 13 of support members 5, 6, so that the ends of said connecting elements 12 pass with end portions 36 at an angle thereto into the lateral edges 13 of support members 5, 6 and the inner faces of end portions 36 are connected in step-free and gap-free manner to the free longitudinal edges of the associated outermost ribs 34 on the insides of support members 5, 6. On their top and bottom surfaces approximately at right angles to the central axes 21, 22, connecting elements 12 are provided with slot-like cavities 37, which are defined at both ends and symmetrical to the median longitudinal planes thereof, so that in cross-section, the connecting elements are constructed as a result of these cavities in the manner of double T-sections. Both connecting members 12 and connecting members 11 are elastically deformable to a limited extent in all directions at right angles to the median longitudinal axes thereof and can twist about the latter, so that all the support members 5, 6 have a limited resilient mobility relative to one another permitting easy adaptation to tolerance differences in the position of hotplates to be stacked. Support members 5, 6 are substantially rigid or dimensionally stable.

As in particular shown by FIG. 8, each support unit 3 can receive two superimposed hotplates 2, whose undersides face one another and they then rest in centred form with their ring flanges 18 on both sides of the support unit 3 on the bearing surfaces and their fixing bolts 23 are so juxtaposed immediately adjacent thereto that their end faces are provided close to the bottom surface of the cover of the facing hotplate. The width of gaps 9, 10 correspond to the width of connecting members 38, whereof in each case one is fixed with a radial holder to the underside of the cover 24 of the associated hotplate 22 and is provided with connecting terminals for the electrical connection of the hotplate. The two connecting members 38 of the two hotplates 2 engaging in a support unit 3 are inserted in the two diametrically facing gaps 9, 10 of support unit 3, so that the rotation position of the two hotplates 2 with respect to the support unit 3 is necessarily precisely predetermined and fixed. Thus, the freely laid electrical conductors leading from the resistance heating wires of the plate base member 19 to the connecting member 38 are protected against damage.

Each intermediate layer 4 has a three-layer corrugated paper sheet 39 of two planar cover sheets and a corrugated central sheet, which is provided with its thickness with circular openings adapted to the diameter of the plate base member 19 in the vicinity of the cooking heating surfaces. These openings are juxtaposed with an axial spacing corresponding to the stacking reference grid, which is only slightly larger than the external diameter of hotplates 2 in the vicinity of shield ring 20. On the bottom, each corrugated paper layer 39 is provided with a solid cardboard layer 40 passing over the openings and which is preferably covered on the underside with a thin protective layer of a soft plastic foil. Cardboard layer 40 closes the openings in the corrugated paper layer 39 on one side, so that the bottom-closed centering cavities 41 for the engagement of the place member 19 of hotplates 2 are obtained in such a way that member 19 with its cooking heating surfaces rests firmly and in protected manner on the base surfaces of the centering cavities. The hotplates 2, whose cooking heating surfaces point upwards, in each case rest in protected manner therewith on the protective layer. Through the intermediate layers 4, in each stack column are positioned the identically oriented hotplates, ie with their cooking heating surfaces either pointing upwards or downwards with identical axes, so that hotplates directly superimposed on the same intermediate layer 4 are displaced relative to one another by the eccentricity of the central axes 21, 22.

After removing the hotplates 2 from the stacked packing state, the support units 3 can be stacked in superimposed manner in one another in space-saving manner and therefore kept ready for re-use.

What is claimed is:

1. A hotplate stacker for stacking superimposed hotplates, said stacker comprising:

a support unit for a spacing arrangement between the superimposed hotplates, said support unit having support members with bearing surfaces on upper and lower ends of the support members, for engaging and supporting the superimposed hotplates, the bearing surfaces being distributed on the support members around a circumference of the hotplates, and the support members being spaced with respect to each other and provided with connecting elements providing means for an oriented direct interconnection between said support members, said connecting elements and said support members defining an opening inside of the support unit.

2. A stacker according to claim 1, wherein at least one said connecting element interconnects at least two of the support members of the support unit.

3. A stacker according to claim 1, wherein at least one connecting element is constructed in one piece with associated support members of the stacker.

4. A stacker according to claim 1, wherein at least one circumferential centering surface for the hotplate is provided on the support unit.

5. A stacker according to claim 4, wherein the centering surface is provided on the support member.

6. A stacker according to claim 4, wherein the centering surface is linked with a radially outward boundary of an associated bearing surface of the support unit and projects over the bearing surface.

7. A stacker according to claim 4, wherein the center surface is formed by a curved web linked to an outer circumference of the support unit and converges towards the bearing surface along a central axis of the hotplate.

8. A stacker according to claim 4, wherein in the centering surface forms an obtuse angle with the bearing surface.

9. A stacker according to claim 1, wherein each case two support members are juxtaposed on the hotplate circumference and form between them a gap in the form of a cutout defined in U-shaped form for engagement of a hotplate connecting member.

10. A stacker according to claim 9, wherein two gaps facing one another with respect to the hotplate central axis are open on opposite sides of the stacker.

11. A stacker according to claim 9, wherein an associated bearing surface of the two support members passes in a circular arc over a width of the gap on a side of the stacker defined by a connecting element.

12. A stacker according to claim 1, wherein the support unit is free from support members on two facing sides with respect to a central axis of the hotplate.

13. A stacker according to claim 1, wherein the support unit on two facing sides with respect to a central axis of the hotplate is radially more inwardly displayed than the bearing surface.

14. A stacker according to claim 1, wherein two diametrically facing pairs of support members are provided, whereof each pair assumes a maximum arc angle of about 90°.

15. A stacker according to claim 1, wherein facing support members are interconnected via lateral, chord-like substantially linear connecting elements.

16. A stacker according to claim 1, wherein the connecting elements are roughly at right angles to a central axis of the hotplate.

17. A stacker according to claim 1, comprising two parallel ones of the connecting elements , at approximately equal distance from a central axis of the hotplate and at a distance from said axis smaller than a radius of the bearing surface.

18. A stacker according to claim 1, wherein the support unit is nestingly stackable with a plurality of further similar support units of the stacker.

19. A stacker according to claim 1, wherein the connecting elements are lateral and only take up part of a height of the support members.

20. A stacker according to claim 1, wherein the lateral connecting elements are located roughly at a center of a height between the bearing surfaces and inner faces of the connecting elements are displaced at least slightly outwards relative to associated lateral faces of the connecting elements, at least in a zone of the support members adapted for receiving terminal connections for the hotplates.

21. A stacker according to claim 1, wherein adjacent support members are movably interconnected in an elastically flexible manner to a limited extent in several directions, including at right angles to the bearing surfaces.

22. A stacker according to claim 1, wherein the connecting elements are deformable flexural members.

23. A stacker according to claim 1, wherein substantially parallel hotplate central axes for the two bearing surfaces adapted to undersides of two hotplates on either side of the support unit are displaced with respect to one another by at least a diameter of projecting fixing bolts on the undersides of the hotplates and, compared with a length of the fixing bolts, only have a slightly greater height spacing from one another.

24. A stacker according to claim 23, wherein the support members are sloping in axial section corresponding to mutual displacement of the hotplates.

25. An apparatus according to claim 1, further comprising at least one plate-like intermediate layer for arrangement between facing cooking heating surfaces of double layers of the hotplates, spaced from one another by the support units.

26. A stacker according to claim 25, wherein on one side of the intermediate layer is provided a centering cavity for each hotplate and on another side there is a smooth protective layer.

27. A stacker according to claim 26, wherein the protective layer is a coated-on plastic foil and the intermediate layer has a corrugated paper layer, which is traversed by the centering cavity and is provided on one side with a solid cardboard layer forming the protective layer and closing a bottom of the centering cavity.

* * * * *

UNITED STATES PATENT AND TRADEMARK OFFICE

CERTIFICATE OF CORRECTION

PATENT NO. : 4,699,269

DATED : October 13, 1987

INVENTOR(S) : Kicherer et al.

It is certified that error appears in the above-identified patent and that said Letters Patent is hereby corrected as shown below:

Column 3, line 45, after "the", insert --two--.

Signed and Sealed this

Twenty-eighth Day of June, 1988

*Attest:*

*Attesting Officer*

DONALD J. QUIGG

*Commissioner of Patents and Trademarks*